United States Patent [19]

Hubbard

[11] 4,339,901

[45] Jul. 20, 1982

[54] SYSTEM FOR IMPROVING HEAT INSULATING CHARACTERISTICS OF A BUILDING WALL STRUCTURE

[75] Inventor: S. Eugene Hubbard, Niles, Mich.

[73] Assignee: Kawneer Company, Inc., Niles, Mich.

[21] Appl. No.: 225,771

[22] Filed: Jan. 16, 1981

Related U.S. Application Data

[63] Continuation of Ser. No. 963,187, Nov. 24, 1978, abandoned.

[51] Int. Cl.[3] ..... E06B 3/26

[52] U.S. Cl. ..... 52/202; 49/67; 49/388; 52/397

[58] Field of Search ..... 49/388, 67; 52/202, 52/397, 400, 771, 772, 207, 214, 658, 656

[56] References Cited

U.S. PATENT DOCUMENTS

| | | | |
|---|---|---|---|
| 609,723 | 8/1898 | Arno | 49/388 |
| 618,457 | 1/1899 | Grahn | 49/67 |
| 1,321,224 | 11/1919 | Marvin | 49/192 |
| 1,647,074 | 10/1927 | Bock | 49/193 |
| 1,663,134 | 3/1928 | Lane | 52/475 |
| 2,003,982 | 6/1935 | Swanson | 52/202 |
| 2,228,358 | 1/1941 | Lowry | 52/397 |
| 2,240,591 | 5/1941 | Waterman | 52/475 |
| 2,666,963 | 1/1954 | Kurtz | 49/192 |
| 2,711,233 | 6/1955 | Pierce | 52/214 |
| 3,190,407 | 6/1965 | Grisard et al. | 52/772 |
| 3,527,011 | 9/1970 | Bloom et al. | 49/DIG. 1 |
| 3,768,223 | 10/1973 | Kurz | 52/658 |
| 3,781,973 | 1/1974 | Biebuyck et al. | 52/110 |
| 3,881,290 | 5/1975 | Bouchey | 52/298 |
| 3,978,633 | 9/1976 | Scheidler et al. | 52/400 |
| 3,999,345 | 12/1976 | McKelvey | 52/789 |
| 4,007,717 | 6/1977 | Hubbard | 52/771 |
| 4,145,844 | 3/1979 | Kaspar | 49/501 |
| 4,269,255 | 5/1981 | Nailor et al. | 52/658 |

FOREIGN PATENT DOCUMENTS

| | | | |
|---|---|---|---|
| 2376927 | 4/1978 | France | 52/772 |
| 1000943 | 8/1965 | United Kingdom | 49/62 |

*Primary Examiner*—James L. Ridgill, Jr.
*Attorney, Agent, or Firm*—Mason, Kolehmainen, Rathburn & Wyss

[57] ABSTRACT

A new and improved system for improving the heat insulating characteristics of an existing wall structure includes apparatus for providing an additional panel in spaced relation with a first or existing panel of an existing wall structure having a surround for supporting the edges of the panel. A sash including the additional panel is mounted in spaced apart relation with the first panel and includes peripheral elongated frame elements, each having a body with a transverse cross-section that is proportioned to extend generally normal to a face of the sash panel and providing a greatest resistance to longitudinal bending forces applied to the element acting in a direction generally normal to the face. Means is provided for structurally interconnecting the sash panel with the elongated elements of the sash frame and the sash is pivotally mounted in the surround outwardly of the first glazing panel.

A new and improved method includes measuring the distance between opposite faces of the surround of the existing wall structure in transverse directions and cutting pairs of elongated sash frame elements to a desired length calculated from the measured distance. The elongated sash frame elements are then interconnected at opposite ends to form a generally rectangular sash frame which is mounted in the surround to pivot about an axis extending between one pair of upstanding faces of the surround. An additional insulating panel is then secured in the sash frame around the edges and the sash is pivotally mounted in the surround between a closed position wherein the panels are in substantially parallel, spaced apart, alignment and an outwardly open position pivoted outwardly away from the existing wall panel so that washing of both panels can be readily accomplished when desired.

17 Claims, 13 Drawing Figures

SYSTEM FOR IMPROVING HEAT INSULATING CHARACTERISTICS OF A BUILDING WALL STRUCTURE

This application is a continuation of copending application Ser. No. 963,187, filed Nov. 24, 1978, and now abandoned.

BACKGROUND OF THE INVENTION

1. Field of the Invention

The present invention relates to a new and improved system for improving the heat insulating characteristics of an existing wall structure. The invention embodies both an apparatus for providing an additional, insulating panel in spaced relation with an existing panel of the wall structure and may also include insulating cover elements for improving the heat insulating characteristics of the surround structure that is supporting the existing wall panel. A novel method of fabricating and installing an additional insulating sash is provided which takes into account dimensional discrepancies and/or misalignment of the elements of the existing wall structure. The system is capable of handling unlevel, out of plumb and misaligned elements of an existing wall with a minimal amount of special attention being required, even though such an existing wall structure would render other prior art types of insulating systems virtually useless.

2. Description of the Prior Art

In recent decades, many office buildings and commercial structures have been built employing wall systems having a relatively large percentage of the wall area provided by single thickness glass panels supported in a framework made up of relatively narrow or thin elongated horizontal and vertical metal elements. Because heat and cooling energy costs were not especially significant economic factors at the time many of these buildings were originally built, the emphasis on architectural design and aesthetic values greatly overshadowed any concerns because of heating and cooling costs. Accordingly, a great many of these types of buildings are well designed and nice looking from an appearance standpoint, but have rather poor heat insulating characteristics in the present day economic environment. With the advent of the energy crisis and greatly increased energy costs, emphasis has now been placed on improving the heat insulating characteristics of these types of buildings but, as yet, most of the improvement systems offered or available have many disadvantages from both a cost and an aesthetic point of view. For example, some systems proposed involve the complete removal of the existing single thickness glazing panes and the replacement thereof with new and expensive dual thickness, insulating glass panels. This procedure in addition to being extremely costly results in a substantial disruption of the normal usage of the building during the conversion process. The glass panels that are removed without breaking are often not reused for other purposes and are simply thrown away or destroyed resulting in a substantial economic loss. In addition, many systems presently offered appreciably damage the overall architectural beauty of the building because of wide or large coverings over the existing framing elements to such an extent that the general appearance of a building after the conversion is radically different. Another conversion system being proposed is to provide additional or second insulating glazing panels which are permanently sealed in place with respect to the existing panels, but to effect this type of permanent seal is a very costly and sometimes unsuccessful endeavor in that the air space between the existing and added panels must be void of moisture and other contaminants and the glass panels themselves must be carefully cleaned and maintained in this condition before and during the sealing process so that permanent streaks, smudges and/or other obstructions to vision in the panels are not present.

It is an object of the present invention to provide a new and improved system for improving the heat insulating characteristics of an existing wall structure and more particularly a new and improved system which eliminates or minimizes many or all of the aforementioned disadvantages of the prior art systems.

It is another object of the present invention to provide a new and improved method of increasing the heat insulating characteristics of existing wall structures in an economical and aesthetically sound manner.

Another object of the present invention is to provide a new and improved apparatus for improving the heat insulating characteristics of an existing wall structure and more particularly an apparatus which provides greatly improved heat insulating characteristics without diminishing the overall appearance and beauty of the existing building structure and without substantial disruption of the normal usage of the building.

SUMMARY OF THE INVENTION

The foregoing and other objects and advantages of the present invention are accomplished in a new and improved system for improving the heat insulating characteristics of an existing wall structure which comprises apparatus for employing an additional sash panel in spaced apart relation to each panel of the existing wall which has a surround along the peripheral edges thereof. The additional sash panel is mounted in a sash frame which includes elongated sash frame elements of special design whereby the elements are formed to provide a transverse cross-section proportioned to extend generally normal to the face of the sash panel and provide a greatest resistance to longitudinal bending forces applied to the elements acting in a direction generally normal to the panel face.

In the installation of the new insulating system, the distance between opposite faces of the surround around the edges of the existing wall panel is measured in transverse directions and then pairs of elongated sash frame elements of the specialized cross-section are cut to an appropriate length in accordance with the measured distances. These frame elements are then interconnected together at opposite ends to form a generally rectangular sash frame which is pivotally mounted in the surround of the existing wall structure to pivot about an axis extending between one pair of opposite faces of the surround. The additional insulating sash panel is then mounted in the sash frame and is permanently secured to the frame elements thereof so that the sash may pivot about the pivot axis between a closed position wherein the panels are substantially parallel of one another and an open position wherein the panel of the sash is sloped outwardly away from the existing panel so that both panels may be washed and cleaned from time to time as desired. Elongated weatherstripping or sealing strips are provided between the edges of the sash frame and the surround of the existing wall structure and thus, greatly improved heat insulating characteristics are provided but the overall appearance of the existing wall structure is not materially altered or changed. The novel design of the sash frame elements provides a maximum of strength in the areas needed using a minimum width or facing dimension and this factor also attributes to the economic value of the new and improved system of the present invention.

DESCRIPTION OF THE DRAWINGS

For a better understanding of the present invention, reference should be had to the following detailed description taken in conjunction with the drawings in which.

DESCRIPTION OF THE PREFERRED EMBODIMENT(S)

Figure 1:
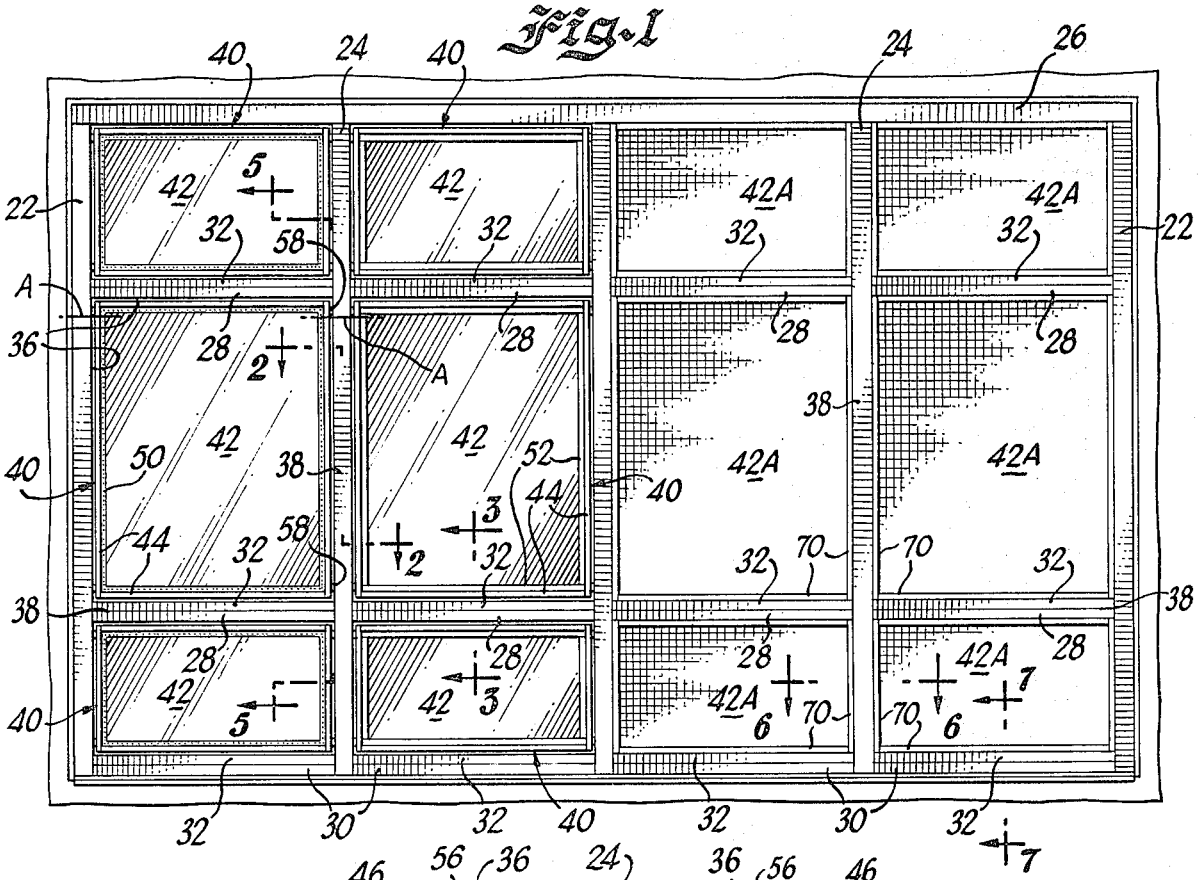
FIG. 1 is an elevational view of a wall structure having improved heat insulating characteristics and constructed in accordance with the features of the present invention.

Referring now to the drawings and more particularly to the embodiment illustrated in FIGS. 1–5, therein is shown an existing wall structure of a well known type which employs relatively large in area, single thickness, rectangular, glazing panels 20 supported in a frame work fabricated of vertically extending jambs 22 and mullions 24 interconnected by horizontally extending headers 26, intermediate horizontals 28, and lower sills 30 which form rectangular openings for receiving the panels and supporting the peripheral edges thereof. The existing wall structure illustrated in the drawings is of the type shown and described in U.S. Pat. No. 3,781,973 issued Jan. 1, 1974 and the divisions and continuations thereof, and these patents are incorporated herein by reference and are owned by the same assignee as the present application.

The vertical and horizontal frame members are formed of extruded aluminum and have a relatively narrow face width in comparison to the relatively large, expansive areas of glass provided by the glazing panels 20 of the wall structure. The present invention is adapted for use with the particular wall structure as shown in the aforementioned patents but is generally adaptable to improve the heat insulating characteristics of wall structures of a similar type which have relatively large glazing areas formed by single thickness glazing panels supported in a grid or frame work of vertical and horizontal structural elements.

As illustrated in FIGS. 2, 6, 8 and 10, the vertical mullions 24 are of generally rectangular hollow, tubular, transverse, cross-section and include internal wall pockets in opposite jamb faces 36 thereof for receiving edge portions of the glazing panels 20 which are supported therein and sealed by means of elongated glazing wedges or gaskets 34. The headers 26, intermediate horizontal members 28 and lower sills 30 of the framework are generally similar in transverse, cross-section to the vertical mullions 24 and also include internal pockets in the jamb faces 36 for receiving the upper and lower edge portions of the glazing panels 20 which again are secured and sealed in place between glazing wedges 34 mounted in the pocket walls. As illustrated in FIGS. 3, 7, 9 and 11, the intermediate horizontal members 28 and the sills 30 include a lower hollow tubular member and a separate removable glass stop element 32 mounted thereon to form the completed horizontal structural element. Both the vertical and horizontal structural frame members include jamb faces 36 which project outwardly of the glazing panels 20 and provide a continuous, surrounding surface around the marginal edges of the glass panels. These surfaces are known as a surround and, in general, the surround surfaces are normal or perpendicular to the outer faces of the glazing panels except for the upper surface of the horizontal members which is usually sloped outwardly and downwardly in order to drain water and other precipitation falling against the wall structure. The spacing distance between the outer surface of the glass panels 20 and outer wall faces 38 of the horizontal and vertical frame members may vary with different types of wall framing systems and this distance is known as the reveal.

In accordance with the present invention, the existing single glazed wall structure is upgraded to provide much better thermal characteristics by means of new and improved, rectangular sash panels 40, which may be fabricated at the building site and fitted within the generally rectangular openings formed by the surround outwardly of the existing single thickness glazing panels 20. In many existing wall structures, the surround surfaces are often out of precise vertical and/or horizontal alignment and may have dimensional discrepancies between upper and lower edges as well as opposite side edges. The present invention provides a system for accommodating these dimensional discrepancies and misalignments with a minimum of special requirements.

Figure 5:
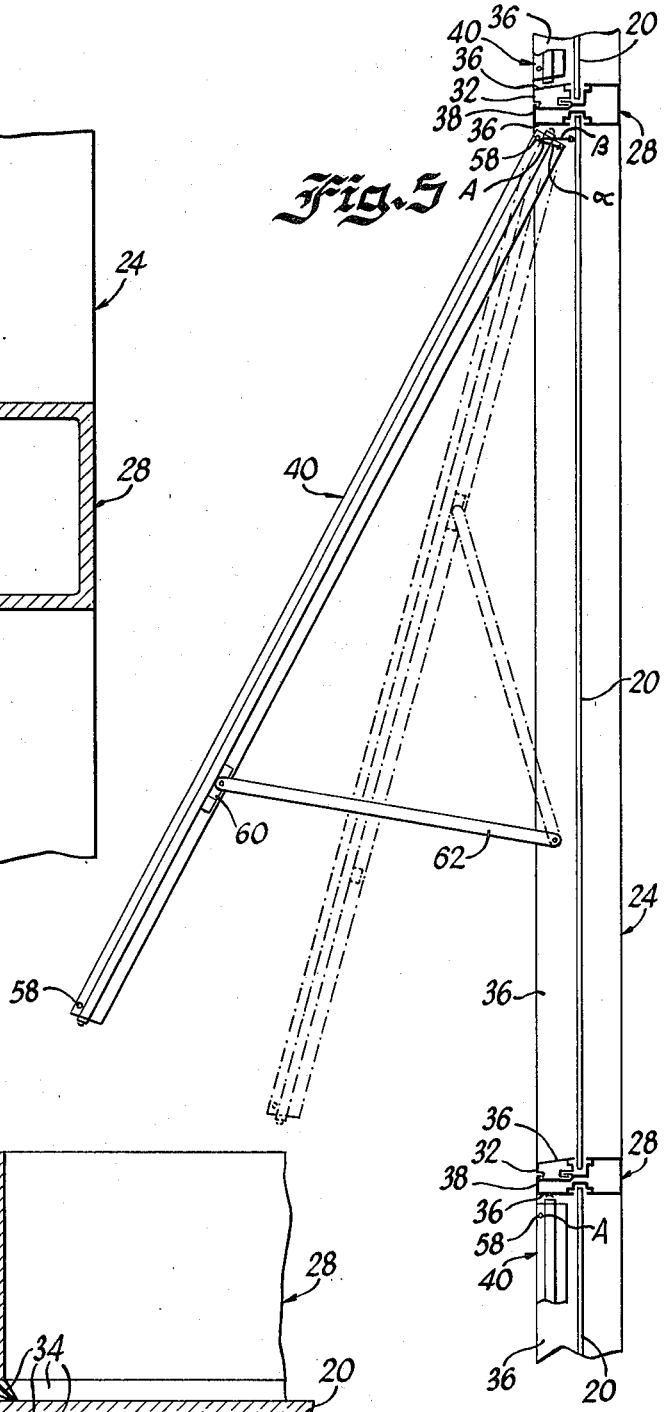
FIG. 5 is a fragmentary, cross-sectional view taken substantially along lines 5—5 of FIG. 1.

Each sash 40 includes an outer glazing panel 42 such as glass and is adapted to be mounted with the outer panel in parallel spaced apart relation outwardly of an existing glazing panel 20. The panels 42 are cut and sized to fit within the surround of the existing wall structure and if the surround surfaces are not precisely rectangular in elevational view, the shape of the storm sashes 40 is matched to accommodate these irregularities. For example, if the vertical surround surfaces are not precisely plum or the horizontal surround surface of existing frame work are not precisely level, the sashes 40 may have to be of a non-rectangular shape such as a parallelogram or trapezoid to fit within the surround openings. If opposite sides of the surround surfaces are out of parallel a slightly trapezoidal shaped sash may result whereas parallel but out of level surrounds will dictate a parallelogram shape or possibly a four sided polygonal shape with the opposite edges of slightly different length and slightly out of parallel. As illustrated in FIG. 5, the sashes 40 are adapted to be pivotally mounted for movement around a horizontal pivot axis a extending between opposite vertical jamb faces 36 of the surround and outwardly of the existing glazing panel 20. However, when desired, the sashes may be mounted for pivotal movement about a generally vertical axis extending between opposite horizontal jamb surfaces 36 of a surround and outwardly of the existing glazing panel 20 of the wall structure. The sashes may also be mounted on the inside rather than outside of the existing glazing panels 20 when desired.

The storm sashes 40 are mounted to pivot about an axis A from a closed, or parallel position wherein the glass panes 42 and 20 are in spaced apart, parallel relation thereby providing improved heat insulating characteristics, to an outwardly pivoted or open position as shown in FIG. 5 so that the surfaces of the existing panel 20 and surfaces of the sash panel 42 may be washed or cleaned from time to time as desired or necessary. The axis A is spaced from the outer face of the panel 20 by a distance (arrow beta) that is greater than the distance (arrow alpha) between the axis A and the adjacent corner of the sash 40 so that there is no interference between the sash and the panel or jamb surfaces 36 when the sash is pivoted to the open position.

The storm sashes 40 include a generally rectangular frame around the peripheral edges of the glass panels 42 and this frame is fabricated from strips of elongated frame elements 44 which are cut to the appropriate length and which have an especially designed, transverse cross-sectional profile or shape in accordance with the features of the present invention. In fabrication of the sashes 40, the spacing or distance between opposite vertical and horizontal surround surfaces 36 are first measured and the frame elements 44 are then cut to appropriate lengths allowing for a spacing or clearance so that when the sash is completed it will be able to pivot freely about the axis A when mounted in the surround as shown in FIG. 5.

After the surround measurements are taken and the sash frame elements 44 are cut to length, the cut lengths are joined together into a generally rectangular sash frame by interconnecting the upper and lower ends of the vertical or side frame elements with the opposite ends of the horizontal frame elements as will be described in more detail hereinafter. The glass panels 42 in themselves are sufficiently strong and rigid to carry the dead load of the completed storm sashes 40 and the transverse cross-section or profile of the side frame elements 44 is designed with this fact in mind. The positive and negative wind loads acting normal or perpendicular to the glass panels 42 subjects the panels to bending stresses and because relatively thin sheets of glass do not provide sufficient capability to withstand these tension and compression stresses imposed by the wind loads particularly along the outer edges of the panels, the frame elements 44 are designed to reinforce and provide the needed strength and rigidity for the sash with a minimum amount of metal being required.

The frame elements 44 are designed to accept and resist the bending stresses imposed on the glass surface by wind loads which act in a direction generally normal or perpendicular of the outer face of the glass panels. These forces tend to bow the glass panels inwardly or outwardly and the frame elements 44 around the peripheral edges of the panels reinforce the edges of the glass and resist the bending forces imposed by the wind loads.

The transverse cross-section or profile of the frame elements 44 is designed to provide a greatest resistance to bending forces applied to the sash and elements thereof in a direction generally normal to the outer face of the glass panels. The depth "D" of the frame elements 44 measured in the direction normal to the face of the glass panels 42 is considerably greater than the distance or thickness "W" (Face width) of the frame elements measured in a direction parallel of the panel face. As illustrated, a typical aluminum extension frame element 44 may be approximately $\frac{3}{8}$ inches in thickness "W" measured in a direction parallel of the glazing panels 42 and may have a depth "D" of approximately $1\frac{1}{4}$ inches measured between the inside and outside edge faces in a direction normal or perpendicular to the panel face. The transverse cross-section of the sash frame elements 44 is thus dimensioned to economically use the bulk of the cross-sectional strength of the metal involved in a manner to provide a cross-section having a greatest resistance to bending stresses which are applied in a direction normal or perpendicular to the face of the panels 42. The bending stresses developed in the glass panels 42 by virtue of wind loads either negative or positive, acting normal to the suface of the glass are transferred from the glass to the frame elements 44 along the edges. The glass is relatively stiff and strong in directions parallel to its own plane and the frame elements 44 need not have nearly as great a thickness "W" taken in this direction parallel of the outer face of the glazing panels because the dead load stresses arising from the weight of the glass panels are amply handled by the glass itself.

In another way of looking at it, the dead weight loading or stresses on the storm sashes 40 is handled by the strength and stiffness of the glass panels 42 in a direction parallel of the face and the bending stresses developed in the glass because of wind loads either positive or negative acting in a direction perpendicular or normal to the surface of the glass in the main is transmitted to the surrounding rectangular metal frame element 44 along the edges of the glass panels. The frame elements have a transverse cross-section which is proportioned to have a major axis perpendicular to the glass and a minor axis parallel of the glass panel. This novel profile provides maximum strength whose needed and a most efficient use of material so that the sashes 40 may be light in weight and easy to fabricate and install in place on an existing wall structure to improve the heat insulating characteristics thereof.

Figure 4:
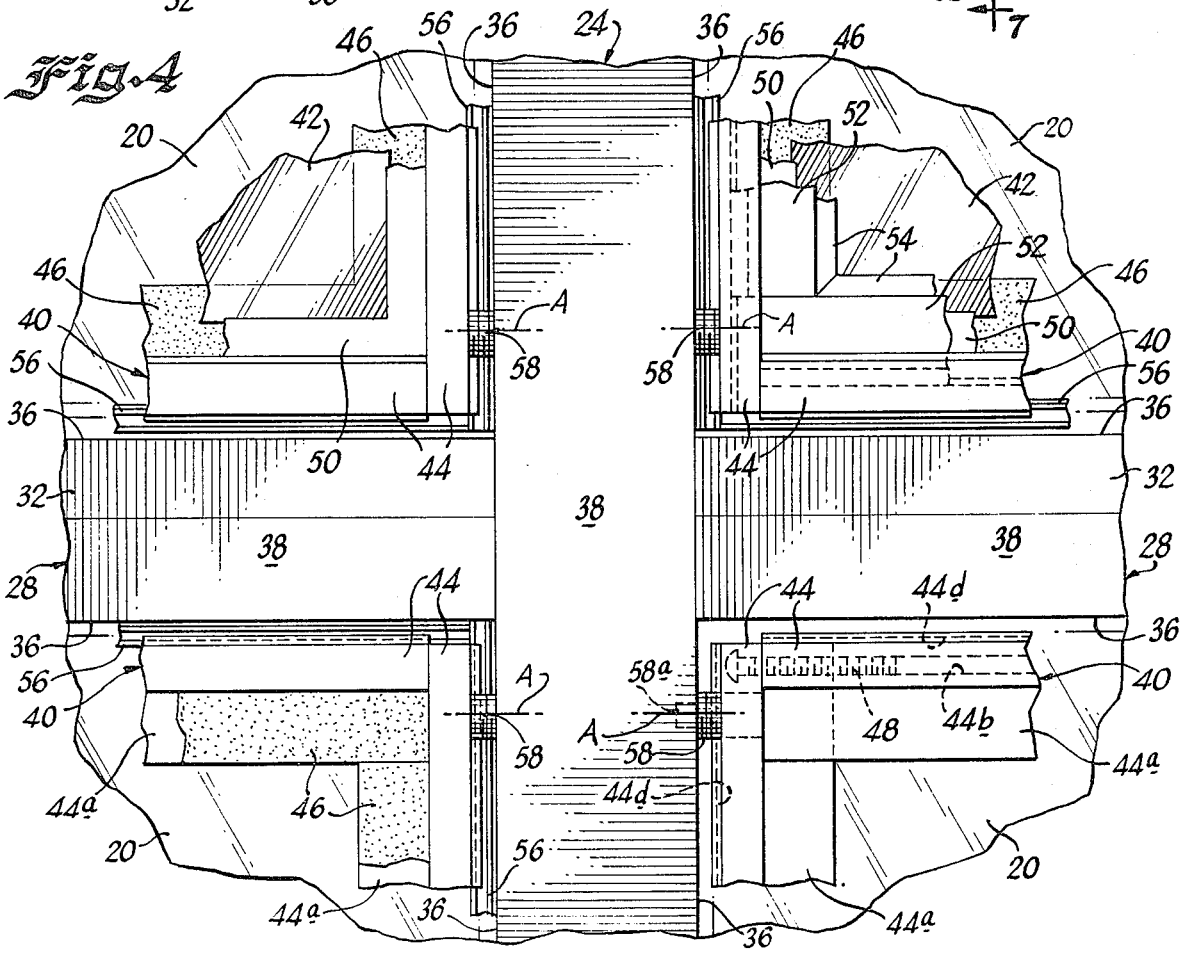
FIG. 4 is a fragmentary, elevational view looking in the direction of arrows 4—4 of FIG. 2 with portions cut away showing components thereof for easier understanding.
Figure 3:
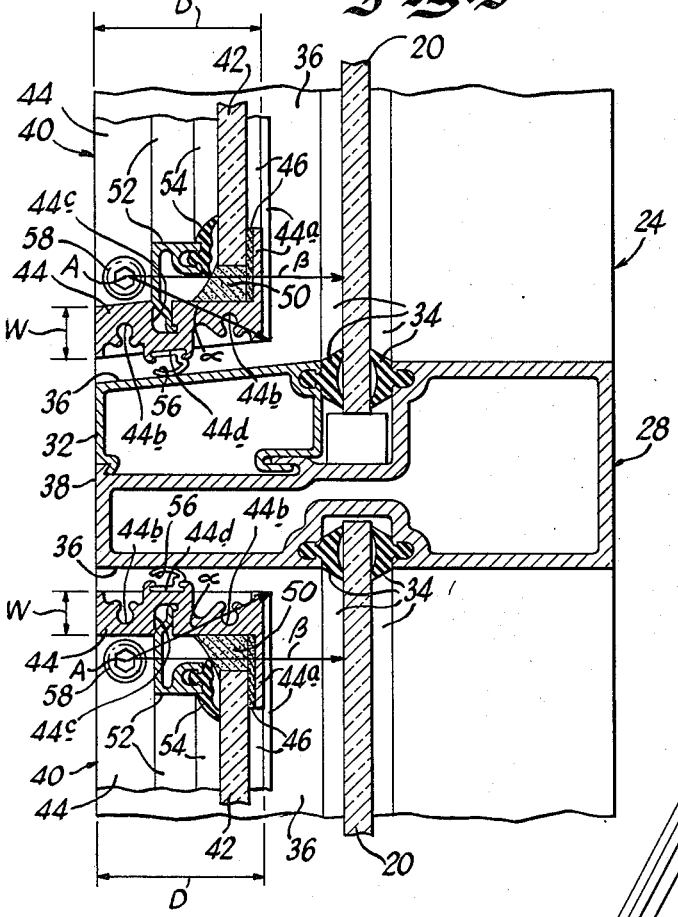
FIG. 3 is a fragmentary, cross-sectional view taken substantially along lines 3—3 of FIG. 1.
Figure 2:
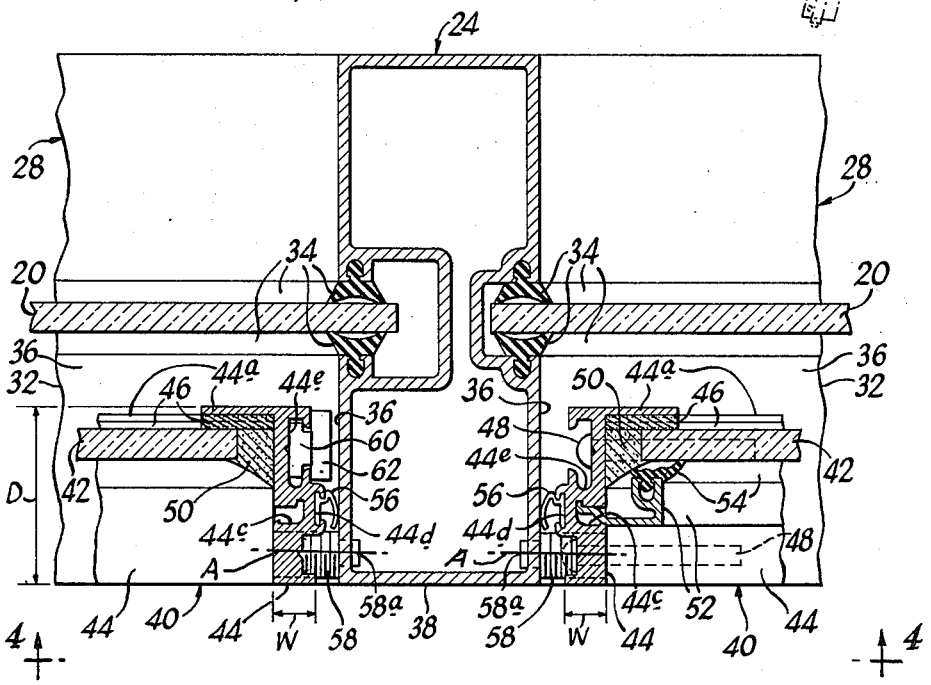
FIG. 2 is a fragmentary, cross-sectional, view taken substantially along lines 2—2 of FIG. 1.

Referring to FIGS. 2, 3 and 4, it will be seen that the sash frame members 44 are provided with relatively thin, integral panel backing flanges 44*a* extending in a direction generally normal or at right angles to the major axis of the main body portion of the extrusion profile. The backing flanges are adapted to provide a supportive edge overlapping base which directly faces the adjacent marginal edge portion of the glazing panels 42. As indicated in FIG. 3, the upper and lower elongated frame elements 44 of each sash 40 are slightly different in cross-sectional profile to accommodate usage adjacent the horizontal framing member glass stop 32 which has a sloping upper surface. The distances "D" thereof is less for the members parallel to the pivot axis A of the sash than the similar distance for the members perpendicular to the pivot axis as shown in FIG. 2. This difference is provided so that the backing flanges 44*a* of the members that are perpendicular to the pivot axis A may overlap the backing flanges of the members that are parallel to the pivot axis as illustrated in FIG. 4 without requiring the corners of the respective transversely intersecting frame elements to be mitered to fit. Accordingly, all end cuts of the members 44 can be at right angles and this greatly facilitates the fabrication of the sash frames 40 at a job site. The glass panels 42 are secured in edge overlapping relation within the rectangular sash frames and are pressed against adhesive tape strips 46 which have adhesive material on opposite sides. These strips are first secured to the flange portions 44*a* of the frame elements 44 and the adhesive faces the peripheral marginal edge portions of the inside faces of the glass panels 42. As shown in FIGS. 2 and 3, the tape strips 46 applied on the frame elements 44 that are perpendicular to the pivot axis have a greater thickness than the adhesive tape strips applied on the frame elements 44 that are parallel to the pivot axis A and this difference in thickness is used to accommodate the overlapping arrangement of the backing flanges 44*a* at the corners of the sash as shown in the drawings.

The sash frame elements 44 that are parallel to the pivot axis A as shown in FIG. 3, are slightly different in transverse cross-sectional profile than the frame elements that are perpendicular to the pivot axis. The elements parallel to the pivot axis have a pair of elongated grooves or screw splines 44*b* for receiving the threaded shanks of pairs of elongated screw fasteners 48 used for interconnecting the frame elements 44 at the corners to form a completed rectangular sash frame ready to receive a glass panel 42.

After measurement of the vertical and horizontal distances between opposing surround surfaces of the jambs 36 is accomplished, and after the horizontal and vertical frame elements 44 are then cut to appropriate length, the vertical and horizontal elements are assembled together by driving the screw fasteners 48 through holes drilled or punched in the frame elements that are perpendicular to the pivot axis aligned so that the threaded shanks of the fasteners will bite into the elongated screw splines 44*b* of the frame elements that are parallel to the pivot axis as shown in FIG. 3.

After assembly of a frame, the strips of adhesive tape 46 are applied to the backing flanges 44*a* and the outer adhesive surfaces of the vertical and horizontal tape strips lie on a common plane ready to receive the inside face of the glass panels 42.

The sash panels 42 are cut to size to fit within the surround and suitable clearances as shown in FIG. 4 are provided. After the frames are mounted in the surround, the glass panels 42 are pressed into position against the adhesive strips as shown. The tape strips hold the panels in place and then a gunned-in-place adhesive sealant caulking material 50 is applied around the marginal edges of the panels between the edges thereof and the adjacent facing surfaces of the frame elements 44. The sealant 50 provides a positive weather seal between the aluminum frame elements and the glass panels and secures the panels to the frame elements 44.

The caulking strips 50 may then be covered or enclosed by means of elongated glazing stops 52 having a generally angle-shaped transverse cross-section and an inwardly directed leg of the stops is grooved to carry an elongated glazing wedge 54 of rubber or plastic providing a further weather seal on the outside surface of the frame around the edges.

As shown in the left hand portion of FIG. 2, and in the upper, left hand portion of FIG. 4, the sashes 40 do not necessarily have exterior glazing stops 52 and wedges 54 and ample strength is provided for holding the glass panels in the frames by the gunned-in-place caulking and sealing strips 50 around the edges of the panels.

In order to lock the angle shaped glazing stops in place, the frame elements 44 are formed with a longitudinal groove 44*c* on the outside wall surface specially adapted to receive an edge portion of a face leg of a glass stop 52, which leg projects into and is interlocked therein as shown in FIGS. 2 and 3.

On the opposite or inside wall surface, the frame members 44 are provided with a longitudinally extending key way or groove 44*d* in which is seated a base portion of an elongated, flexible sealing strip 56 formed of rubber or other suitable plastic material and which includes a curved deflectable, outer sealing lip adapted to establish a sliding or wiping seal against the adjacent jamb surface 36 of the surround when the sash 40 is moved into a closed or parallel position in the surround. This wiping seal forms a relatively tight air seal around the periphery of the frame members 44 of a sash frame 40 and the insulating, dead air space between the respective glass panes 20 and 42 is thus provided to reduce the amount of heat transfer between the inside and outside of the building.

As previously indicated, the stresses arising from the dead load of the glass of the sashes 40 are handled mainly by the glass panes 42 themselves and the wind loads resulting in bending load stresses perpendicular to the panes are transferred from the glass panes 42 to the frame members 44 around the edges via the tapes 46 and the caulking and sealing strips 50. The outer glass stops 52 and the outer sealing wedges 54, when present, may also aid in the transfer of bending stress from the glass to the frame elements 44 but mainly these items provide a cover over the outer surface of the gunned-in-place caulking and sealing strips 50.

The flexible, wiping or sliding type seal provided by the strips 56 between the facing surfaces of the frame elements 44 and the jamb surfaces 36 of the existing wall structure permits the sashes 40 to be mounted for free pivotal movement between a closed or parallel position as shown in FIGS. 2 and 3 wherein the glass panels 42 and 20 are in substantially parallel spaced apart alignment, and an outwardly open position as shown in FIG. 5, wherein the facing surfaces of the inner and outer glass panes 20 and 42 are exposed and accessible for window washing from time to time. In order to support the sashes 40 within the surround of the existing building wall structure and transfer wind loads and dead loads thereto, there are provided pairs of small, threaded pins or locking screws 58 which extend to threaded openings formed in the sash frame members 44 adjacent the corners thereof as shown in FIGS. 2, 3, 4 and 5. These threaded pivot screws include cylindrical shank portions 58*a* at the end which seat in openings drilled in the faces 36 of the surround members at appropriate locations and aligned concentrically of the pivot axis "A".

Preferably, the pivot screws are formed of stainless steel or other weather resistant material compatible with aluminum and may be of the socket head type so that the screws are flush and almost unnoticeable or unobtrusive in appearance. As illustrated in FIGS. 3 and 5, the pivot screws adjacent one corner of a sash frame 40 may provide a supporting axle for the frame and the pivot screws 58 at another opposite corner than can function as a locking screw which is tightened inwardly to secure the frame in place and which is loosened at other times to permit the outward pivoting movement. The screws also serve to transfer loads from the sashes 40 to the surfaces 36 of the existing wall structure. If required for stiffness, when large glass frames are involved, additional pivot screws may be provided at intermediate locations between the corners of the sash frame.

In order to support the sash 40 in an outward open position as shown in FIG. 5, so that window washing may be accomplished, the sash frame elements 44 that are perpendicular to the pivot axis A are provided with longitudinally extending key ways or grooves **44*e* which face the adjacent surround surfaces 36 and which accommodate T-shaped slides 60 which are pivotally secured to the outer ends of pivot arms 62. These pivot arms in turn have inner ends pivotally secured with appropriate fasteners to the opposite jamb surfaces 36. In order to move a sash 40 from the closed, parallel position to the outwardly open position ready for washing, one set of locking screws 58 are loosened to free one edge portion of the sash from attachment from the surround faces 36 of the building. The free portion of the sash is then pivoted outwardly and as this occurs, the slides 60 in the grooves 44*e* move lengthwise away from the pivot screws in the grooves and the support arms 62 pivot outwardly as shown in FIG. 5 until the open position desired is finally obtained. The dotted lines of FIG. 5 illustrate the sash 40 in an intermediate position between the closed position and the outwardly open position, and as the sash is opened further, the slides 60 move further along in the grooves 44*e***.

Figure 6:
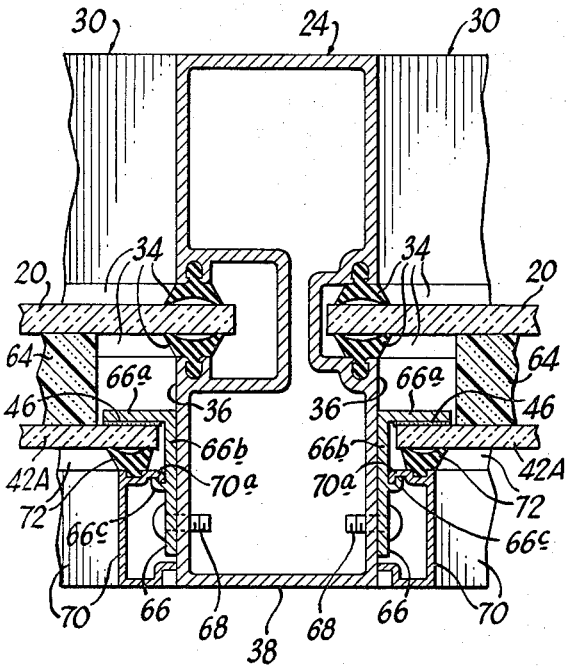
FIG. 6 is a fragmentary, cross-sectional view taken substantially along lines 6—6 of FIG. 1.
Figure 7:
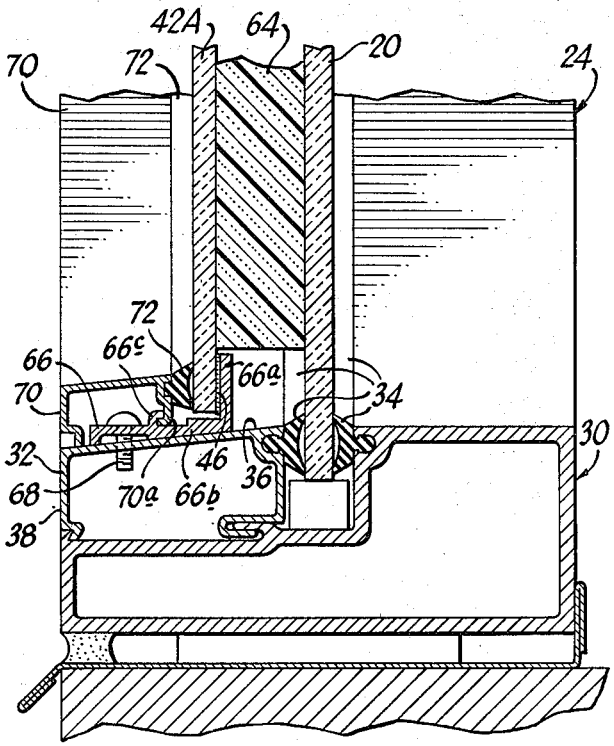
FIG. 7 is a fragmentary, cross-sectional view taken substantially along lines 7—7 of FIG. 1.

Referring now to the embodiment shown in FIGS. 1, 6 and 7, therein is illustrated another embodiment of the present invention wherein the panels 20 of the existing wall frame structure are covered over and insulated by means of additional outer panels **42*a* which are formed of plastic, glass or other materials which may be opaque rather than transparent. Sandwiched between the inner and outer panes 20 and 42A there is provided an insulating sheet or panel 64** of substantial thickness or body, formed of foam or other insulating material having extremely good heat insulating characteristics.

The additional insulating panels 42A and 64 are secured permanently in place within the surrounds formed by the jamb surfaces 36 by means of an elongated edge frame element 66 having backing flanges **66*a* integrally formed and extending generally perpendicular or normal to outwardly extending jamb legs 66*b* which are secured to the jamb faces of the vertical and horizontal members by means of fasteners 68. A relatively thin, glazing tape 46 having an adhesive material on both sides is provided on the outer faces of the flanges 66*a* to hold the panels in place. An outer panel stop 70 of generally channel-shaped, transverse cross-section is then interlocked in place as illustrated, and these panel stops include an inner leg 70*a* engageable with a rib 66*c* provided on the jamb leg 66*b* of the frame members 66. The inner legs 70*a* of the glass stops are also provided with a groove for holding a strip of elongated outside glazing wedge 72 which bears against the outside face of the panels 42A** along the peripheral marginal edges thereof.

In the installation of the system as shown in FIGS. 1, 6 and 7, the frame members 66 are measured and cut to fit within the vertical and horizontal jamb surfaces 36 forming the surround of the existing wall structure. After cutting, they are then fitted into place and secured to the jamb faces with the fasteners 68. The adhesive tape strips 46 are mounted in place on the flanges **66*a* and the insulating panels 64 and outer panels 42A are pressed into place with the inside surfaces of the panels 42A adhesively secured to the outside faces of the tape strips 46. The channel-shaped glass stops 70 are then cut to appropriate lengths and the outside glazing wedges 72 are mounted in the grooves thereof on the legs 70*a*. The stops are then snapped into interlocking relation with the ribs 66*a* on the frame elements 66**. This system provides an excellent, highly thermally efficient conversion of an existing wall structure to provide for much lower energy costs for heating and cooling.

Figure 8:
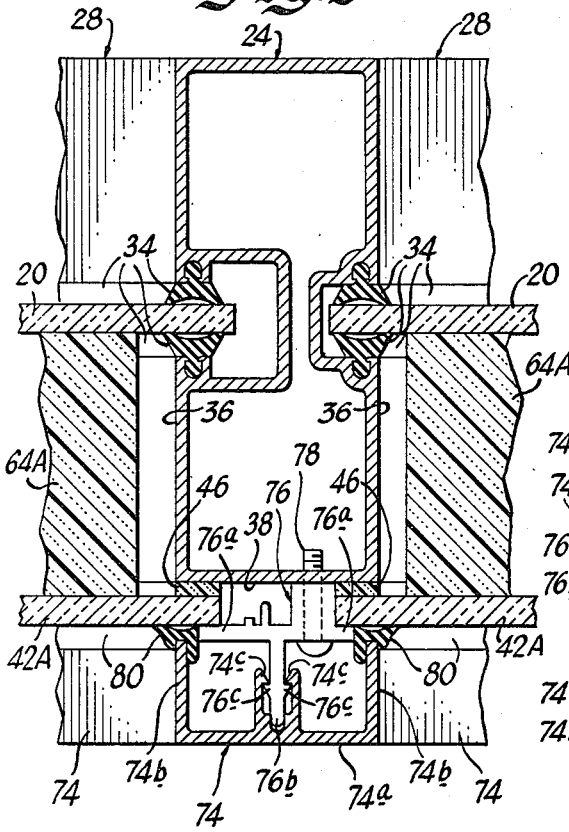
FIG. 8 is a fragmentary, cross-sectional view similar to FIG. 6 but illustrating yet another embodiment of the present invention.
Figure 9:
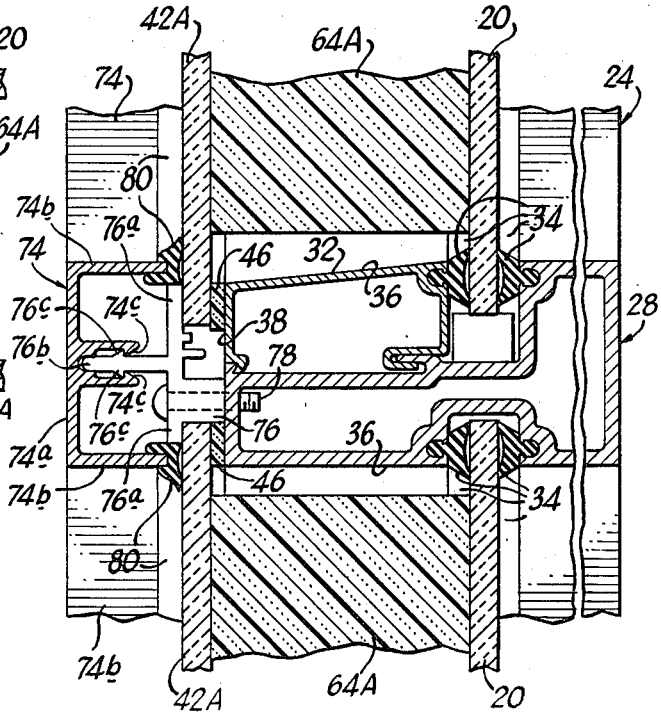
FIG. 9 is a fragmentary, cross-sectional view similar to FIG. 3 but showing the embodiment of FIG. 8 in a vertical cross-sectional view.

Referring now to FIGS. 8 and 9, therein is illustrated another embodiment of the present invention wherein insulating panels 64A of a somewhat greater thickness are sandwiched between the panels 20 of an existing wall structure and new additional outer panels 42A. The outer panels 42A are pressed into place against facing tapes 46 having adhesive on opposite faces which have been applied to the outer faces 38 of the frame work structure of verticals and horizontals of an existing wall system. In order to provide even more improvement in the heat insulating characteristics, the metal frame work of the existing building wall structure is insulated with elongated insulating covers 74 having a generally channel-shaped, transverse cross-section and preferably fabricated of extruded aluminum or the like with an outer wall face or web **74*a* having a width approximately equal to the outer wall face 38 of the existing wall structure frame elements. The covers 74 include opposite leg portions or jamb faces 74*b* extending inwardly from the opposite edges of the outer web 74*a* and these leg or jamb face portions are aligned with the jamb faces 36 of the existing wall structure framing elements. The covers are supported in heat insulating relation on the outer faces 38 of the existing vertical and horizontal frame members by means of longitudinally spaced clip elements 76 which are formed of strong, heat insulating plastic material and secured to the existing vertical and horizontal frame members at appropriate intervals thereon by means of screw fasteners 78 extending through a hollow bore in a main body portion of the clip as shown in FIGS. 8 and 9**.

Each clip includes a pair of wing portions **76*a* extending laterally outwardly of the main body portion and the outer ends of these wing portions are adapted to bear inwardly against the outer edge surface of the panels 42A for positively holding the panels in place on the existing wall structure frame work as illustrated. The clips 76 also include an outwardly extending tongue 76*b* having a pair of wedge shaped barbs 76*c* on opposite sides adapted to snappingly interlock and positively engage a pair of enlarged, inner edge portions or ridges 74*c* provided on a pair of inwardly extending internal legs of the cover elements 74. The outside legs or jamb faces 74*b* of the cover elements 74 are parallel of the internal legs. Elongated, outside, glazing wedges 80 are mounted on the edges of the outside jamb faces and these wedges press inwardly against the outer marginal edge surface of the panels 42A. After the insulating sheets 74A and the panels 42A are pressed into place with the inside marginal edge surface of the panels bearing against the adhesive tape strips 46, the insulating chips 76 are then installed at appropriate intervals by driving in the screws 78 to threadedly hold in the outer wall faces 38** of the frame members of the existing wall structure.

The insulating clips are formed of heat insulating material such as "Nylon" or other plastic and are relatively strong with excellent heat insulating characteristics. After the clips are in place at the desired spacing along the outer faces 38 of the existing frame structure, the channel-shaped outer cover elements 74 are cut to appropriate lengths and the glazing wedges 80 are installed thereon. These cover elements are then pushed inwardly into position on the clips until the ridges **76*c* on the tongue 76*b* of the clips are positively interlocked with the enlarged ridges 74*c* on the internal legs of the cover elements. The resulting structure as shown in FIGS. 8 and 9**, thus provide excellent heat insulating characteristics in that both the panel areas and the existing frame members are provided with additional heat insulating protection.

Figure 10:
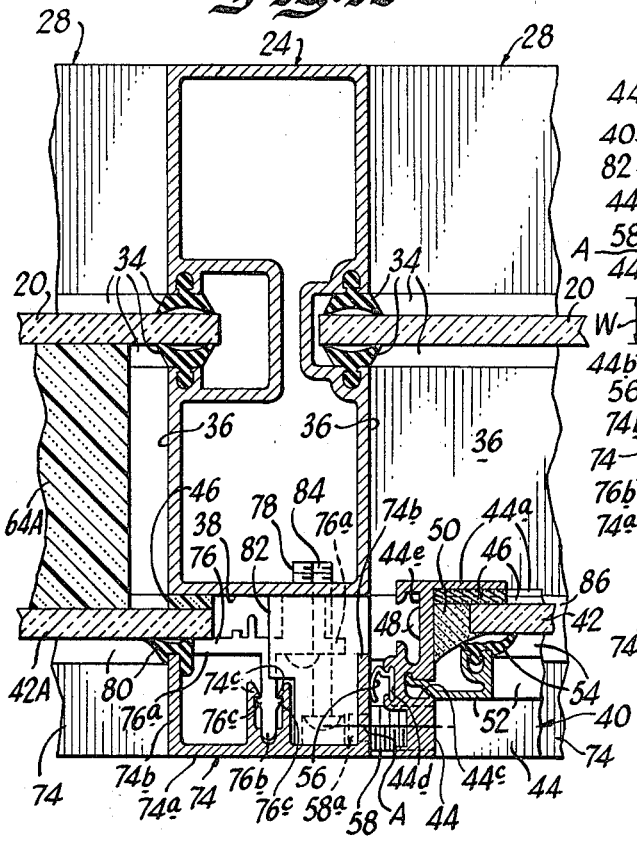
FIG. 10 is a fragmentary, cross-sectional view similar to FIG. 6 but illustrating yet another embodiment of the present invention.
Figure 11:
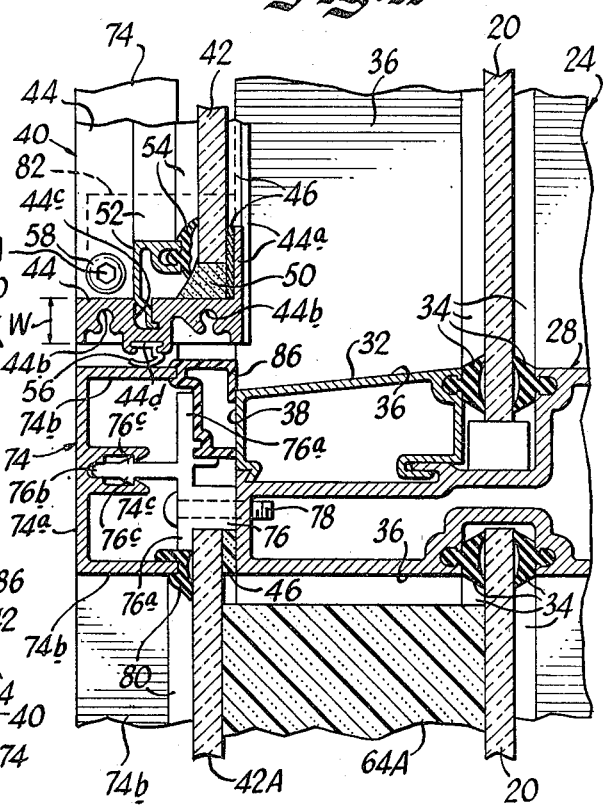
FIG. 11 is a fragmentary, vertical cross-sectional view similar to FIG. 3 but illustrating the embodiment of FIG. 11.

Referring now to FIGS. 10 and 11, these figures illustrate the sash system of FIGS. 1 through 5 which is fully compatible with the insulating cover system of FIGS. 8 and 9. As illustrated on the right hand portion of FIG. 10, a sash 40 as previously described is provided for improving the heat insulating characteristics of the wall system while on the left hand portion, an insulating construction including a relatively thick insulating panel 64A and an outer panel 42A is provided along with frame work cover elements 74 for insulating the existing metal frame members of the existing wall structure.

In order to secure the sashes 40 in place for pivotal movement on the cover elements 74 on the vertical existing frame members, pairs of relatively large, insulating, pivot blocks 82 are mounted on the outer face 38 to support and back up the right hand leg or jamb face **74*b* of the cover element at the level of the pivot axis a and supporting pivot screws 58. These pivot blocks are mounted on the outer surface 38 of the existing mullion frame structure by means of elongated screw fasteners 84. The back up, pivot blocks 82 are formed of heat insulating material such as "Nylon" or other plastic material and provide a supporting shoulder for the inside surface of the jamb surfaces 74*b* of the cover members 74 so that sufficient strength is provided to support the weight and loading of the sash 40 and transfer these forces which are received through the pivot screws 58 into the existing frame members. The cylindrical inner end portions 58*a* of the socket type pivot screws project into drilled openings provided in the cover jamb 74*b* and the supporting pivot blocks 82** which provide a journal or bearing surface.

FIG. 11 illustrates the compatibility of the fixed and pivot sash systems wherein a pivotal sash frame 40 is mounted in an upper opening and an insulating panel 64A and an outer panel 42A are mounted in the opening below the sash receiving opening. The relatively large insulating pivot blocks 82 are again provided at appropriate levels on the vertical frame members wherever the socket type pivot or locking screws 58 are located. As illustrated, the upper jamb face or leg **74*b* of the horizontal cover element 74 is interconnected with an elongated stop element 86 of channel shaped, transverse, cross-section having an upper wall portion extending between the sill glass stop 32 of the frame member and the cover element 74. A lower wall portion of the interconnecting stop element bears against the outer face 38** of the horizontal structural member.

It should be noted that the elongated flexible sealing strips 56 provide a wiping seal with the outer jamb faces of both the vertical and horizontal cover element legs or jamb surfaces **74*b* in a manner similar to the wiping or sliding type seals established between the sealing strips 56 and the surround jamb surfaces 36 of the existing structure as shown in the prior embodiments. Because the outer faces of the jamb legs 74*b* are in alignment with the existing structural surround surfaces 36, the interfitting of the sashes 40** is readily accomplished without interference.

Figure 12:
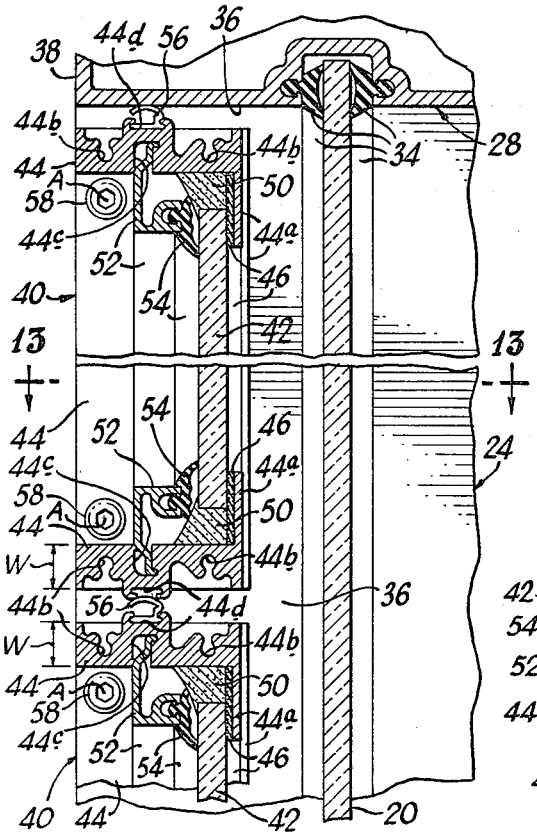
FIG. 12 is a fragmentary, vertical cross-sectional view of yet another embodiment of the invention.
Figure 13:
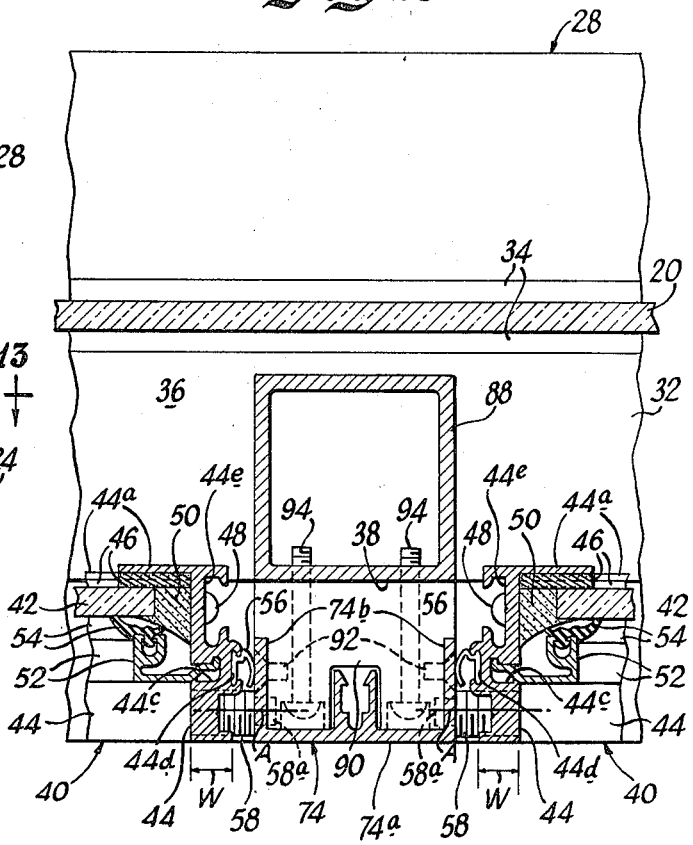
FIG. 13 is a fragmentary horizontal cross-sectional view taken substantially along lines 13—13 of FIG. 12.
Figure 1:
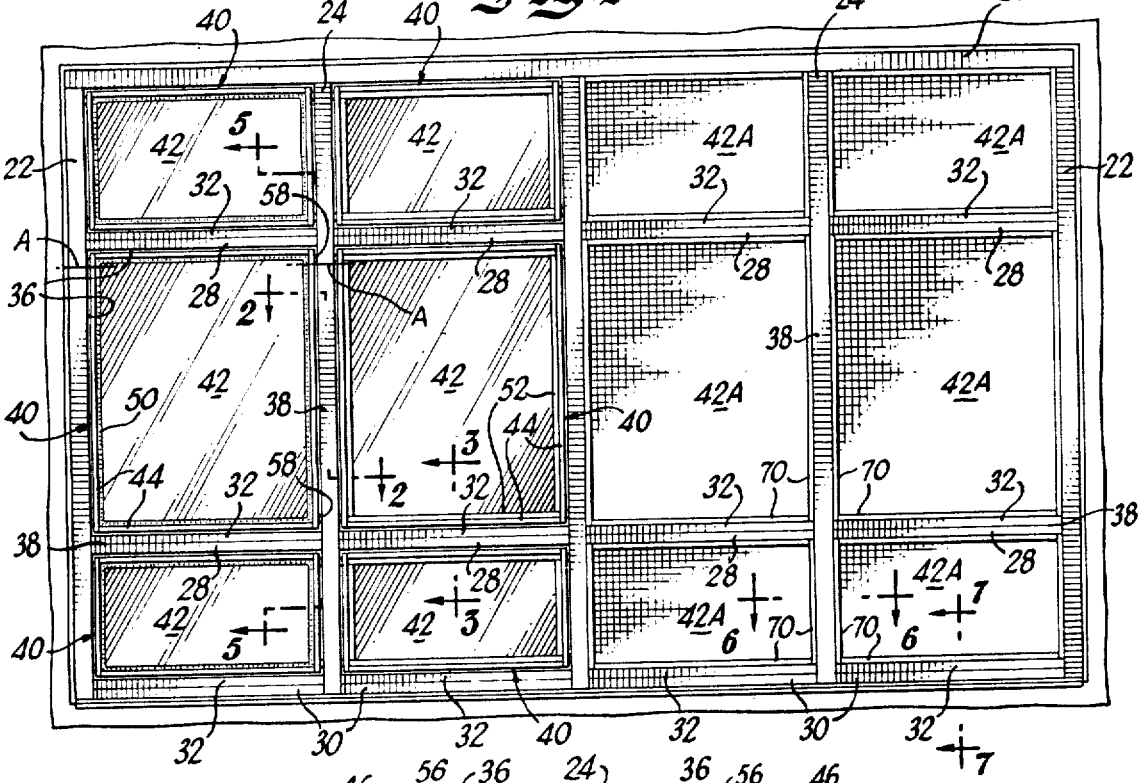
Figure 4:
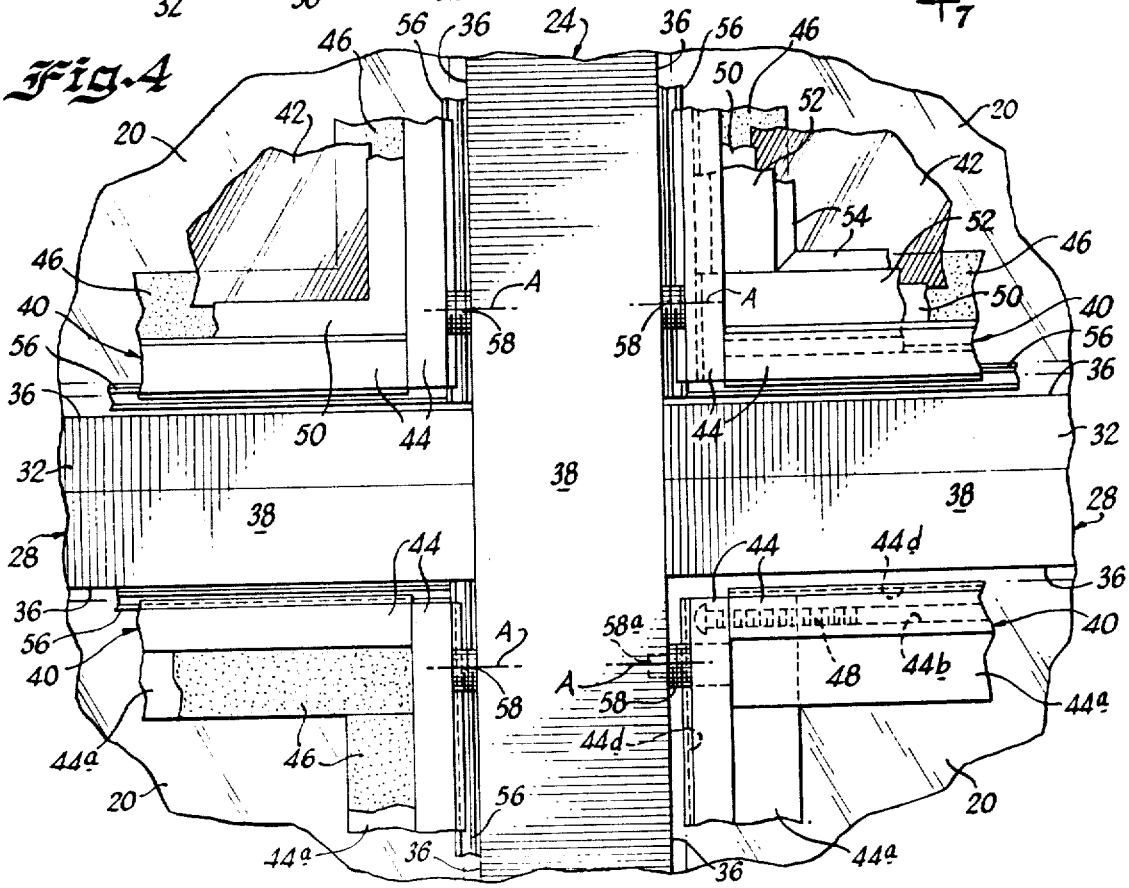
Figure 3:
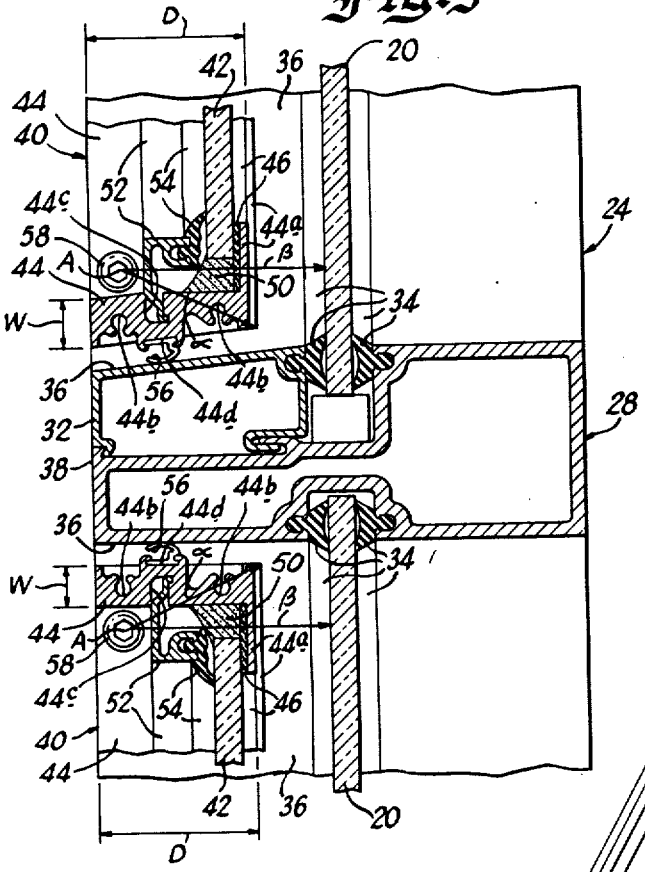
Figure 5:
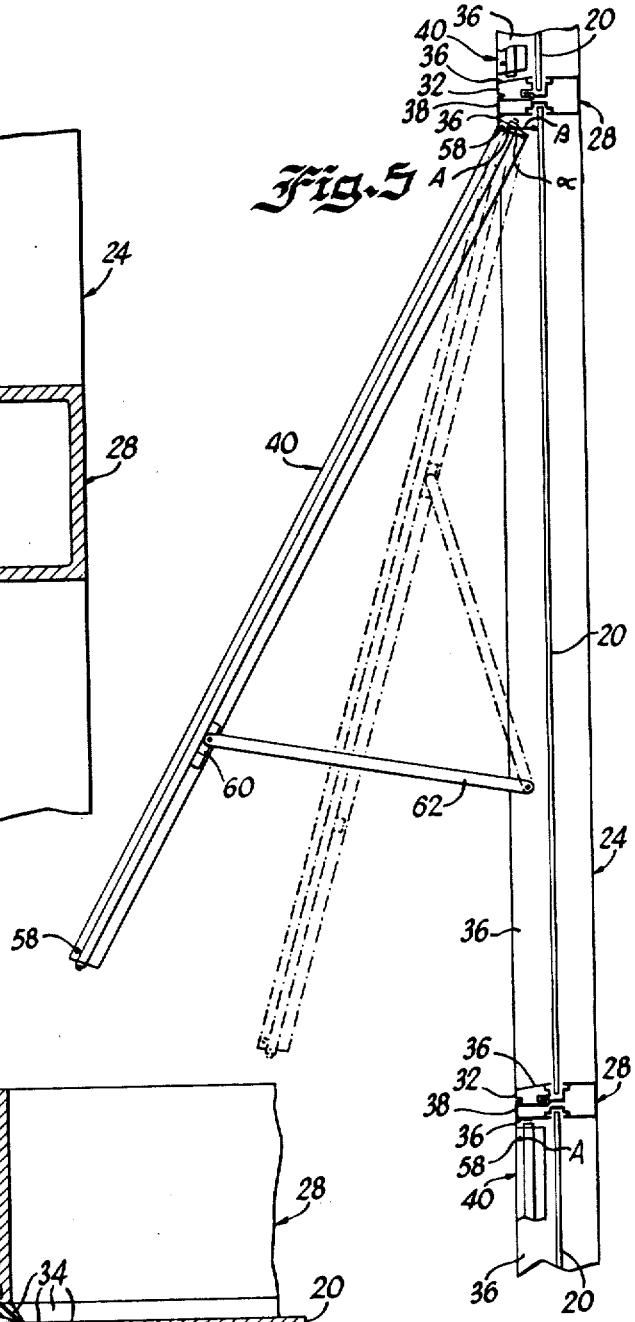
Figure 2:
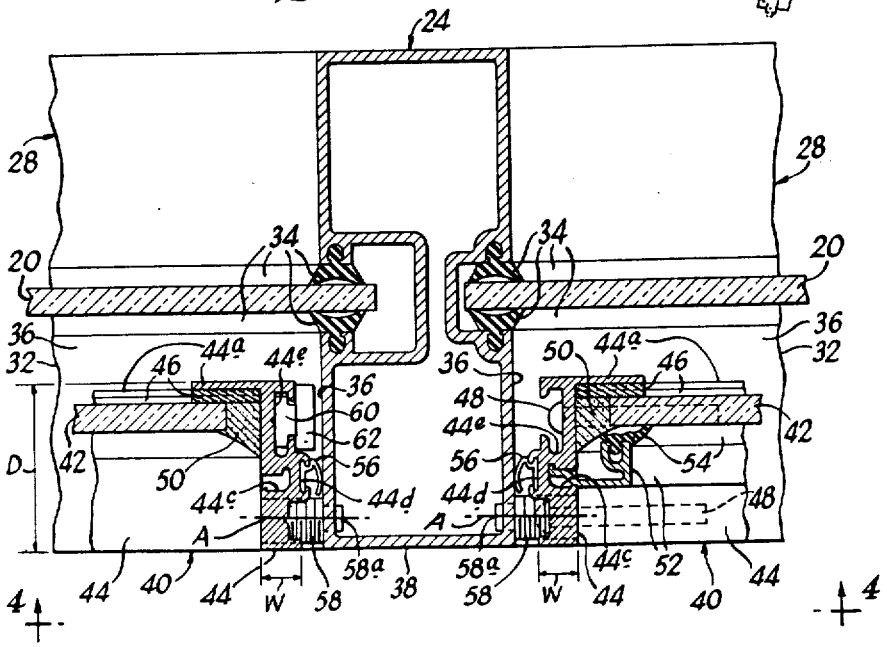
Figure 6:
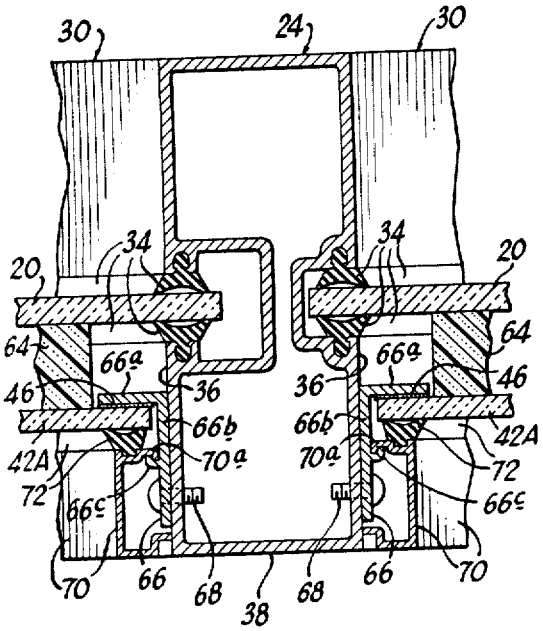
Figure 7:
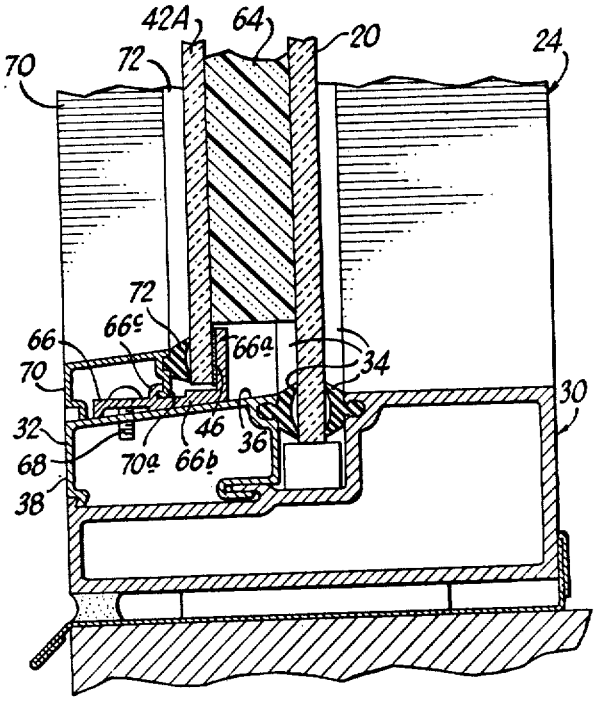
Figure 8:
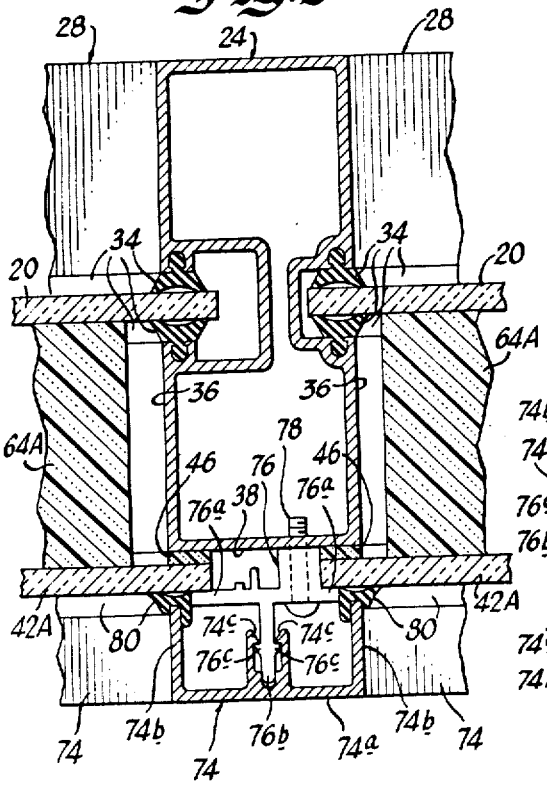
Figure 9:
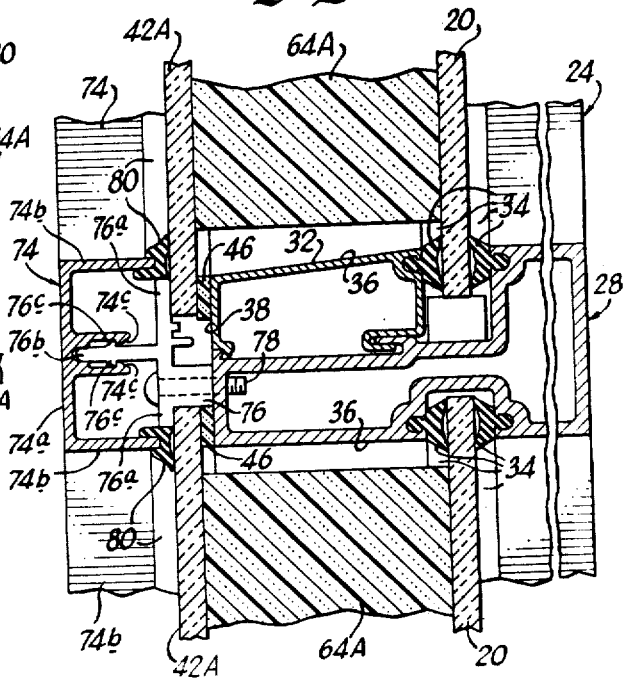
Figure 10:
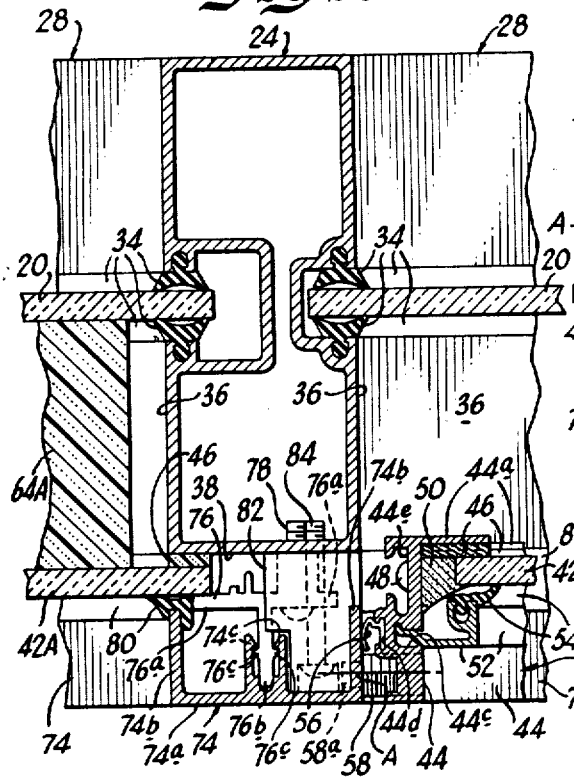
Figure 11:
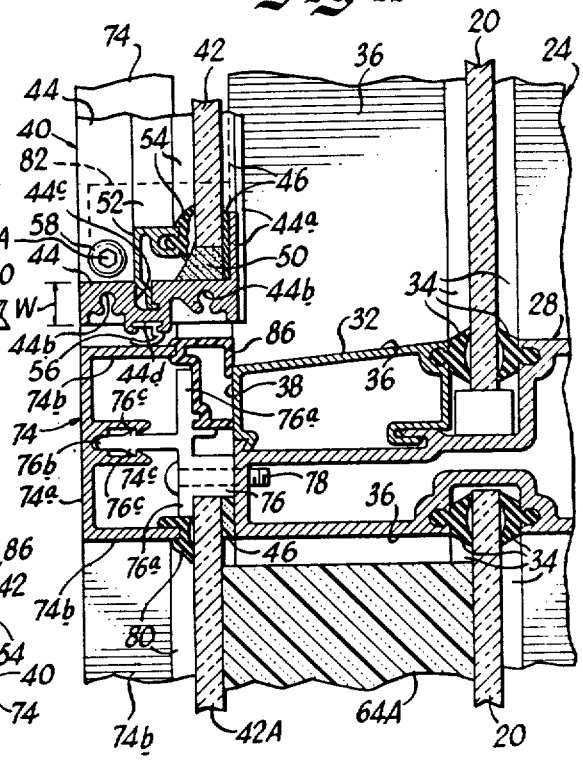
Figure 12:
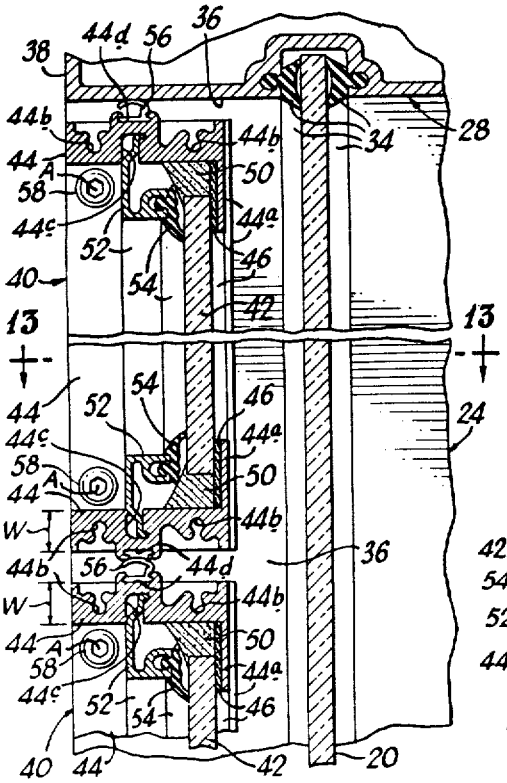
Figure 13:
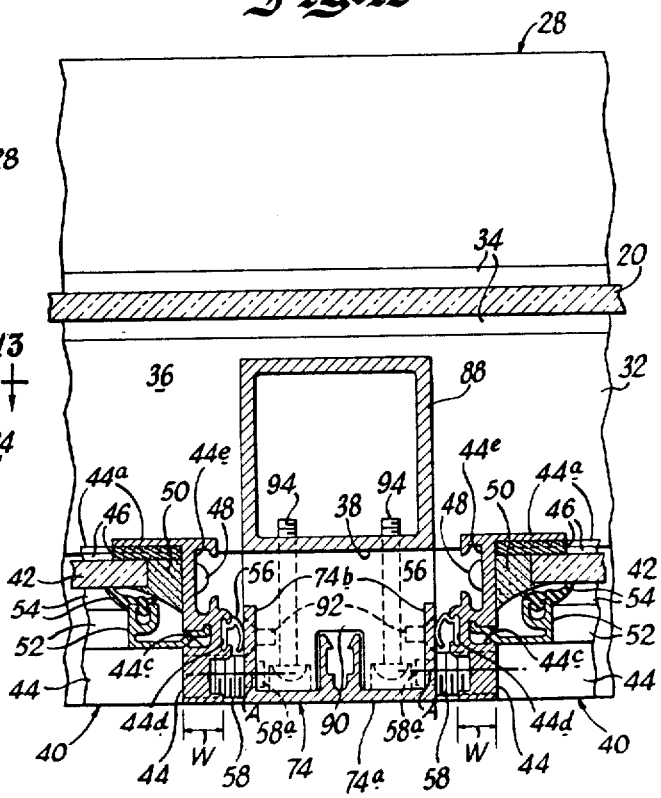

Referring now to FIGS. 12 and 13, when the existing glass panels 20 are sufficiently large in either a horizontal or a vertical dimension, it is desirable to provide a pair of separate sashes 40 stacked side by side or one on top of the other, or both ways, to cover the large size openings. In FIG. 12 is illustrated a system wherein a pair of insulating, pivotally mounted sashes 40 are stacked vertically and it should be noted that a wiping seal is established by a single sealing 56 mounted in the upper horizontal element 44 of the lower sash to provide a weather seal against the lips forming the sealing strip channel **44*d* on the bottom face of the lower frame element 44** of the upper sash.

Referring to FIG. 13, in the event that the horizontal dimension of an existing glass area covered by a single panel 20 is sufficiently large, it may be desirable to stack the individual sashes 40 in a horizontal direction or side by side in order to reduce the size of the sashes 40. In this event, an intermediate hollow vertical structural post 88 is installed to extend vertically between the upper and lower facing jamb surfaces 36 of the surround opening. The structural post 88 is of a hollow, rectangular or square shaped transverse, cross-section and is spaced outwardly away from the outside surface of the existing glass panel 20 as illustrated. An outer face of the post is aligned flush or coextensive with the outer surfaces 38 of the existing horizontal and vertical frame elements. Cover elements 74 are provided on the horizontal frame members as illustrated in FIG. 11 in a customary manner and vertically extending cover elements are mounted in place on the outer surface of the hollow posts 88 by means of large size insulating pivot blocks 90 formed of heat insulating material and provided with shouldered recesses on opposite jamb faces thereof in order to receive leg portions or jamb surfaces **74*b* of the cover element which is secured thereto by screw fasteners 92. The insulating pivot blocks 90 are secured to the outer surface of the hollow post 88 by means of screw fasteners 94 and the blocks are positioned at appropriate levels to support the cover elements 74 and provide additional strength to provide a bearing surface for the cylindrical, inner end portions 58*a* of the pivots and locking socket screws 58. The insulating pivot blocks also provide additional strength for supporting the vertical cover elements 74 on the post to take the loading from the sashes 40 as transferred by the pivot screws 58** as in the previous embodiment.

The intermediate post 88 is dimensioned so that its opposite faces are in alignment with the opposite jamb surfaces on the side legs 74*b* of the cover element 74. A wiping or sliding type seal is provided between the surfaces of the cover legs and the adjacent frame members 44 of the sashes 40 by means of the sealing strips 56 as in the previous embodiments. The pivotally mounted sashes as described may be pivoted about horizontal axes extending between opposite vertical jamb surfaces 36 in the surround of an existing wall structure and these pivot axes may be positioned adjacent the upper portion or the lower portion or edges of the sash as desired. The sashes 40 may be mounted for pivotal movement about vertical axes extending between upper and lower jamb faces of the horizontal frame members and the vertical pivot axes may be positioned adjacent either side of a sash so that the sash can pivot from either side of the existing surround.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A separate, self-contained, discrete insulating sash for use with a building wall structure of the type including at least one pair of generally parallel, spaced apart, opposed, facing, undifferentiated, relatively flat fixed wall surfaces having spaced apart first and second longitudinal edges and a second wall surface extending generally normal to one of said fixed wall surfaces adjacent a first longitudinal edge thereof toward a first longitudinal edge of the opposite fixed wall surface, said fixed wall surfaces and said second wall surface defining a recess in said wall structure having an open side adjacent said second longitudinal edges of said fixed wall surfaces;

said insulating sash adapted for mounting in said recess between said first and second edges of said fixed wall surfaces, said sash including a sash panel having one side facing said second surface of said wall structure and an opposite side facing toward an open side of said recess;

a frame around a peripheral edge portion of said sash panel including at least one pair of elongated frame elements parallel and spaced between said first and second longitudinal edges of said fixed wall surfaces, said frame elements including a pair of spaced apart, wall segments having opposing wall faces generally normal to and projecting toward said open side of said recess from said sash panel, said wall segments being structurally bonded to the adjacent edges of said sash panel;

each elongated frame element having a transverse cross-section with a flange element extending generally parallel to a face of said sash panel and said wall segments extending generally normal to said face of said sash panel, said cross-section providing a greater strength to resist against longitudinally spaced bending forces applied to said frame element by virtue of a wind load acting on said sash in a direction generally normal to the face of said sash panel than against applied forces acting on said sash in a direction generally parallel of a face of said sash panel; and a pair of pivot pins mounted on said respective wall segments of said frame elements adapted to engage said respective adjacent fixed wall surfaces of said building wall structure for pivotally supporting said sash in said recess for movement about a pivot axis extending through said opposing wall faces of said frame elements between said fixed wall surfaces, said axis aligned in spaced apart, parallel relation to said opposite side of said sash panel toward said open side of said recess and adjacent a transverse edge of said sash extending between said frame elements and adjacent to said second wall surface of said building wall structure, said pivot axis being spaced a radial distance from said transverse edge less than the radial distance between said pivot axis and said second wall surface of said recess in said building wall structure to permit said sash to pivot on said pivot axis to a position sloping away from said second wall surface without interference between said transverse edge of said sash and said second wall surface of said building wall structure.

2. The insulating sash of claim 1 including:

a pair of removable, support pins mounted on said respective wall segments of said frame elements and spaced from said pivot axis, said support pins extendable from said wall segments to engage respective adjacent fixed wall surfaces of said building wall structure for supporting said sash in a first position mounted within said recess of said building wall structure between said first and second edges of said fixed wall surfaces.

3. The insulating sash of claim 1 wherein said sash panel is spaced between said pivot axis and said second surface of said building wall structure when said sash is in said first position in said recess.

4. The insulating sash of claim 1 wherein said wall segments include second wall faces in facing adjacent relation with said respective fixed wall surfaces of said building wall structure, and elongated weatherstrip means on said sash for weather sealing between said second wall faces and said fixed wall surfaces of said building wall structure.

5. The insulating sash of claim 4 wherein said weatherstrip means includes a flexible sealing lip for slidable wiping contact with said fixed wall surfaces of said building wall structure to permit pivotal movement of said sash on said pivot axis.

6. The insulating sash of claim 1 wherein said edges of said sash panel are structurally bonded to said frame elements by a bead of gunned-in-place material forming an adhesive bond and seal between said edges of said sash panel and respective adjacent wall faces of said wall segments.

7. The insulating sash of claim 6 including at least one elongated cover element having a first wall portion parallel of a face of said sash panel, in covering relation over said bead of material and having an edge interlocked with said wall segment, said cover element having a second wall portion extending from said first wall portion toward said face of said sash panel.

8. The insulating sash of claim 7 including an elongated glazing strip of elastomeric material mounted between an edge of said second wall portion of said cover element and said face of said sash panel.

9. The insulating sash of claim 1 including structural bonding means for structurally bonding opposite edge portions of said sash panel with adjacent portions of said elongated frame elements including adhesive means between and structurally interconnecting opposite edges of said sash panel and adjacent ones of said respective faces of said wall segments of said elongated frame elements.

10. The insulating sash of claim 9 wherein said structural bonding means includes adhesive means between and structurally interconnecting a face of said sash panel with an adjacent wall surface of a flange segment of said elongated frame elements.

11. The insulating sash of claim 9 wherein said adhesive means includes means for transmitting forces received by virtue of dead loads acting in a direction generally parallel of a face of said sash panel between said sash panel and said elongated frame elements.

12. The insulating sash of claim 9 wherein said adhesive means includes means for transmitting forces received by virtue of live loads acting in a direction generally normal to a face of said sash panel between said sash panel and said wall segment of said frame elements.

13. A method of improving the heat insulating characteristics of a building wall structure of the type having a fixedly positioned surround including at least one pair of spaced apart, generally parallel, flat, fixed wall surfaces having spaced apart first and second longitudinal edges and a second wall surface generally normal to one of said fixed wall surfaces and extending along a first longitudinal edge toward a first longitudinal edge of an opposite fixed wall surface, said fixed wall surfaces and said second wall surface defining a recess in said wall structure having an open side facing toward said second longitudinal edges of said fixed surfaces, said method comprising the steps of:

measuring the transverse distance between said opposite fixed surfaces of said surround;

cutting at least one pair of elongated sash edge elements to a length determined from the measured distance in the aforementioned step;

interconnecting together opposite ends of said sash edge elements after being cut to length and forming thereby an independent, generally rectangular panel carrying sash frame;

mounting said sash frame in said recess on a pair of pivots interconnecting said pair of sash edge elements and respective adjacent fixed wall surfaces within said recess to provide capability for relative pivoting movement of said sash frame about a pivot axis extending transversely across said frame between said pair of fixed wall surfaces of said recess, said axis spaced from said second wall surface toward said open side of said recess and spaced adjacent one end of said sash edge elements; and mounting an insulating sash panel in said sash frame by securing the panel along opposite edges to said respective sash edge elements while said sash frame is positioned in said recess of said building wall structure thereby forming a self-contained insulating sash mounted for pivotal movement between a closed position wherein said sash panel is substantially parallel to said second wall surface within said recess and a position wherein said sash is pivoted outwardly, angularly away from said second wall surface of said building wall structure.

14. The method of claim 13 including the step of mounting an elongated weatherstrip on said sash for sealing between each of said elongated sash edge elements and an adjacent fixed wall surface of said recess of said building wall structure.

15. The method of claim 13 or 14 wherein said sash panel is secured along said opposite edges to said sash edge elements by applying a strip of gunned-in-place adhesive material between said panel and said sash edge elements.

16. The method of claim 13 or 14 wherein said pivots are installed in threaded engagement with said sash edge elements and project into pivot openings formed in said respective adjacent fixed wall surfaces in said recess of said building wall structure.

17. The method of claim 13 including the step of:

installing a pair of removable lock pins between said pair of sash edge elements and said respective adjacent fixed wall surfaces within said recess remote from said pivots to retain said sash in said closed position in said recess.

* * * * *

UNITED STATES PATENT AND TRADEMARK OFFICE

CERTIFICATE OF CORRECTION

PATENT NO. : 4,339,901

DATED : July 20, 1982

INVENTOR(S) : S. Eugene Hubbard

It is certified that error appears in the above-identified patent and that said Letters Patent is hereby corrected as shown below:

The single sheet of drawing should be deleted to be replaced with four (4) sheets of drawings as shown on the attached sheets but will apply to the Grant Only.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*